US008343283B2

(12) United States Patent
Nijburg

(10) Patent No.: US 8,343,283 B2
(45) Date of Patent: Jan. 1, 2013

(54) CLEANING WITH CONTROLLED RELEASE OF ACID

(75) Inventor: Rudolf E. Nijburg, Gorinchem (NL)

(73) Assignee: Purac Biochem BV, Gorinchem (NL)

( * ) Notice: Subject to any disclaimer, the term of this patent is extended or adjusted under 35 U.S.C. 154(b) by 595 days.

(21) Appl. No.: 12/385,700

(22) Filed: Apr. 16, 2009

(65) Prior Publication Data

US 2010/0263690 A1 Oct. 21, 2010

(51) Int. Cl.
*C23G 1/02* (2006.01)
*C11D 3/37* (2006.01)

(52) U.S. Cl. ..... 134/3; 134/25.2; 134/28; 510/220; 510/229; 510/230

(58) Field of Classification Search ..... 134/2, 3, 134/25.2, 28, 29, 42; 510/22, 229, 230, 233, 510/235

See application file for complete search history.

(56) References Cited

U.S. PATENT DOCUMENTS

| | | | | |
|---|---|---|---|---|
| 4,115,309 | A | 9/1978 | Krause et al. | |
| 5,110,868 | A * | 5/1992 | Bellis et al. | 510/193 |
| 5,879,469 | A * | 3/1999 | Avram | 134/25.2 |
| 2001/0031714 | A1 | 10/2001 | Gassenmeier et al. | |

FOREIGN PATENT DOCUMENTS

WO WO 92/12228 7/1992

OTHER PUBLICATIONS

International Search Report issued in International Patent Application No. PCT/EP2010/054907 mailed May 28, 2010.
Written Opinion on Patentability issued in International Patent Application No. PCT/EP2010/054907 mailed May 28, 2010.
European Search Report issued in European Patent Application No. EP 09 15 8027, on Sep. 17, 2009.

* cited by examiner

*Primary Examiner* — Saeed T Chaudhry
(74) *Attorney, Agent, or Firm* — Oliff & Berridge, PLC

(57) ABSTRACT

The present invention discloses a method for cleaning a substrate comprising contacting the substrate in a cleaning cycle with an aqueous cleaning solution comprising an aqueous diluent and a detergent composition, the detergent composition comprising a glycolic and/or lactic acid oligomer with an average degree of polymerization between 1.8 and 6. Preferably, the substrate is contacted in a rinse cycle with an aqueous rinse which is substantially free of an intentionally added rinse agent or fabric softener.

8 Claims, 2 Drawing Sheets

CLEANING WITH CONTROLLED RELEASE OF ACID

The present invention relates to the field of neutral to alkaline cleaning, especially in automatic washing machines.

During the cleaning cycle in an automatic washing machine, the substrates, e.g. dishes or laundry, are cleaned by circulating a detergent solution over the substrates. This detergent solution is obtained by mixing a detergent in water, which detergent can contain components such as alkalinity agents, builders, bleaches, enzymes, surfactants for defoaming or cleaning, polymers, corrosion inhibitors etc. Commercial machine washing detergents are known to operate at alkaline pH, making them less efficient in removal of scale and soap scum. During intensive use a scale layer may accumulate inside the automatic washing machine. In addition, scale deposits may be visible on certain substrates after washing.

Typically, in dish washing a separate rinse step using a rinse aid composition is being applied to prevent built-up of and/or to remove these hard water deposits. Rinse aid compositions further typically contain components which aid the wetting of the substrates in the rinse, such as nonionic surfactants and/or hydrotropes, and sometimes other additives improving the efficacy of the rinsing process, such as polymers, silicones, etc. These rinse aid compositions are not designed for the achievement of a primary soil removal purpose and may be added during the rinse cycle of the machine, separately from the detergent composition employed in the main cleaning cycle(s). The ability to enhance rinsing, and in particular the ability to prevent spot and scale formation, are common measures of rinse aid performance.

In order to provide convenient products to consumers and to eliminate detergent handling and dosing issues, manufacturers have been making dishwashing tablets containing at least a detergent and a rinse aid function in one tablet. Such tablets sometimes are referred to as 2-in-1 tablets or as tablets with a built-in rinse aid.

Some 2-in-1 tablets have a wax portion which contains the rinse aid. These types of tablets have disadvantages since they may only be used in a wash cycle that does not exceed 55° C., because the wax portion which contains the rinse aid will completely dissolve in a wash cycle that exceeds 55° C. This causes all of the rinse aid to drain out of the dishwashing machine before the actual rinse cycle. Furthermore, such 2-in-1 tablets are very complicated and expensive to produce.

Other types of tablets that are well known are pH sensitive 2-in-1 tablets. These types of tablets have a rinse aid portion that is contained in a pH sensitive material. The pH sensitive 2-in-1 tablets may be used in wash cycles that exceed 55° C.

US 2001031714 relates to a laundry, dishwashing or cleaning detergent portion having two or more detersive components of which at least two are to be released into the liquor at different points in time in a laundering, dishwashing or cleaning process, said portion comprising at least one release controlling (physico)chemical switch which is not subject or not exclusively subject to temperature control, and also one or more substances for increasing the extent of the shift in pH. Such components for release into the respective liquor at a later stage of the cleaning process may be provided with a pH shift sensitive coating, compounded into a detersive formulation using a pH shift sensitive binder, or compounded into a detersive formulation using a pH shift sensitive matrix material.

Figure 1A:
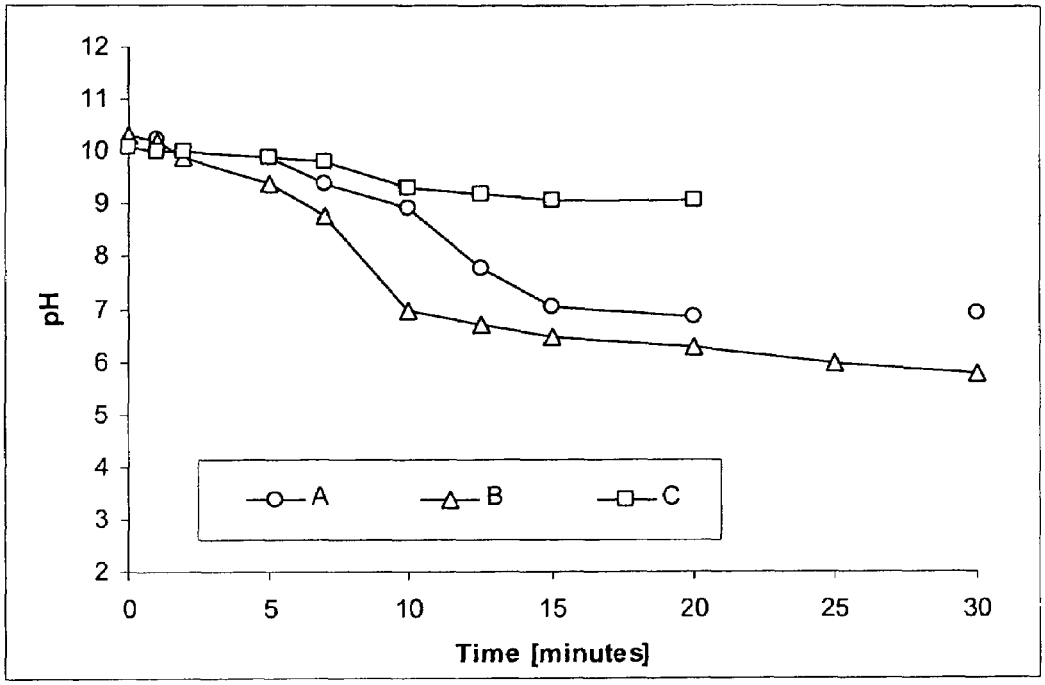
FIGS. 1A, B, C are plots of the development of the pH over time for compositions A to I (lactide based machine dishwashing formulations).
Figure 1B:
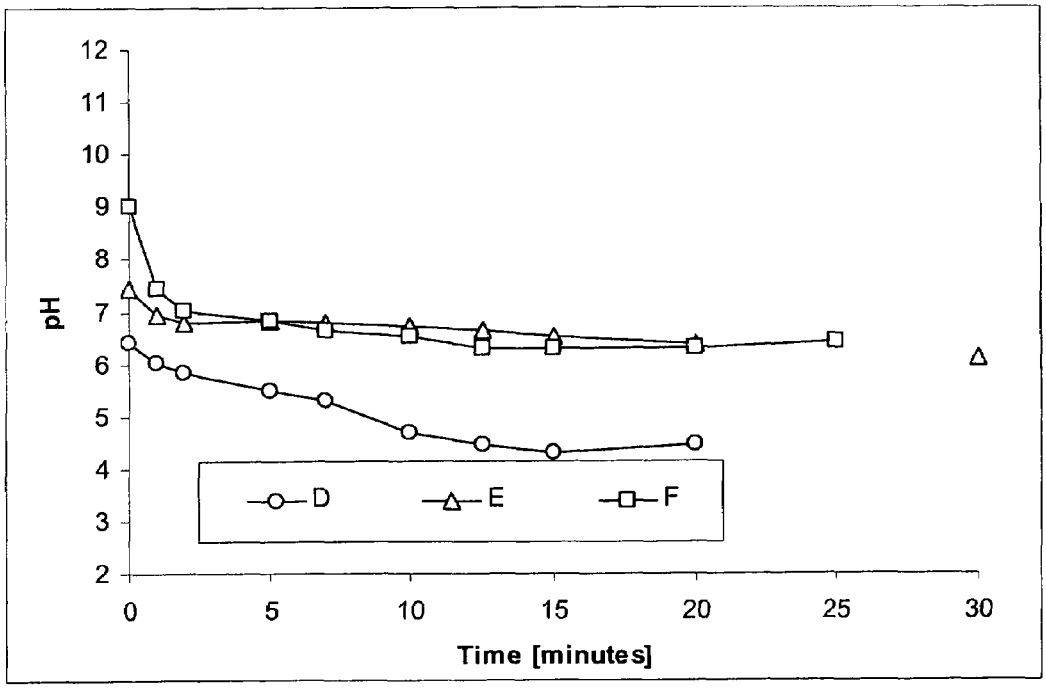
Figure 1C:
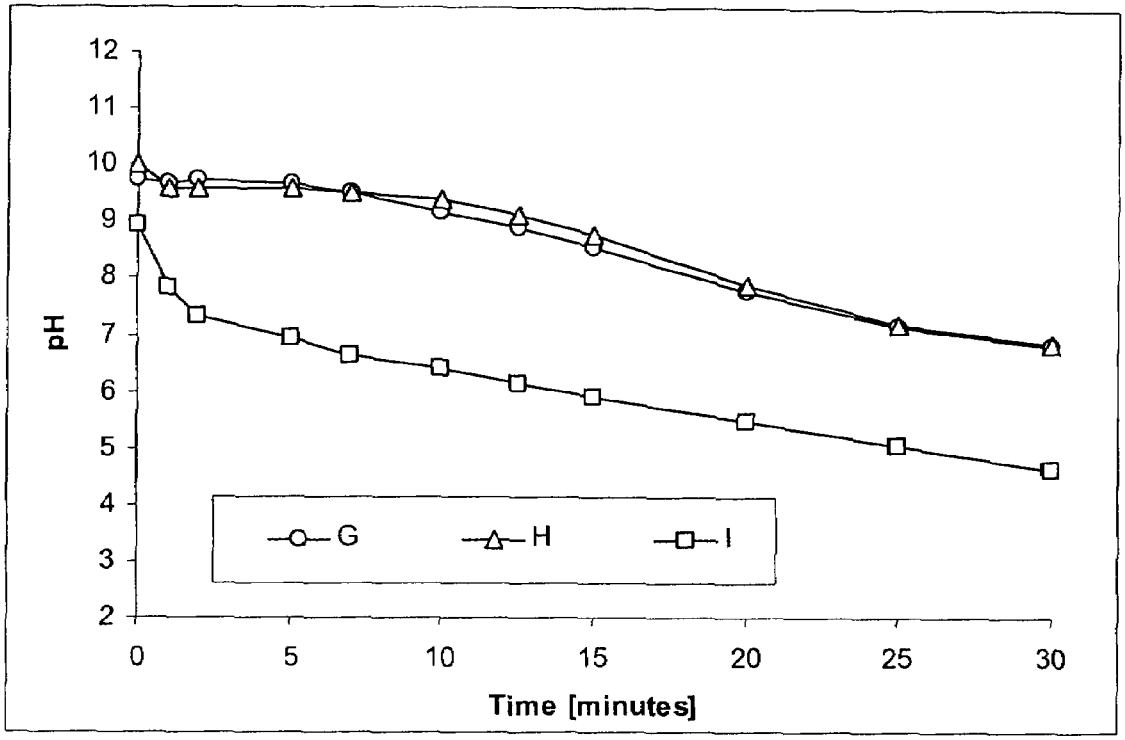

The inventors of the present invention now have found that controlled release of acid from a glycolic and/or lactic acid oligomer with an average degree of polymerization between 1.8 and 6, preferably between 1.8 and 4, in a cleaning cycle in an automatic washing machine advantageously obviates the need to dose a separate rinse aid in the rinse cycle.

Thus, in a first aspect, the present invention discloses a method for cleaning a substrate comprising contacting the substrate in a cleaning cycle with an aqueous cleaning solution comprising an aqueous diluent and an detergent composition, the detergent composition comprising a glycolic and/or lactic acid oligomer with an average degree of polymerization between 1.8 and 6.

Preferably, the substrate then is contacted in a rinse cycle with an aqueous rinse, which aqeous rinse is substantially free of an intentionally added rinse agent.

The glycolic and/or lactic acid oligomer as described herein is water-insoluble and is biodegradable. The oligomer is a polyester which reacts with water upon contact therewith, i.e. the water hydrolyses the ester bond. It has been found that the use of such an oligomer with a degree of polymerization in this range provides a controlled release of water-soluble glycolic acid and/or lactic acid and generates a pH gradient during the cleaning cycle.

In this way, the alkaline detergent component(s) can properly exert its cleaning function in the initial stage of the cleaning cycle, since use of the glycolic and/or lactic acid oligomer ensures that glycolic and/or lactic acid is slowly released such that it exerts its function predominantly in a later stage of the process.

Controlled release of the glycolic and/or lactic acid in the cleaning cycle advantageously obviates the need to dose a separate rinse aid in the rinse cycle after the cleaning cycle, or to dose a separate fabric softener. The aqueous rinse thus is substantially free of an intentionally added rinse aid or fabric softener. Preferably, no rinse aid or fabric softener at all is intentionally added to the aqueous rinse.

Controlled release of acid in the cleaning cycle reduces or prevents the formation of hard water (calcium and magnesium salts) deposits in the washing machine and/or on the substrates to be cleaned, and thus obviates the need to use special washing machine cleaners. Controlled release of acid also contributes to soap scum removal.

In laundry applications, formation of mineral incrustation on garments occurs. This incrustation is essentially made up of non water-soluble calcium and magnesium salts of fatty acids, carbonate and, to a lesser extent, silicate and zeolite. These deposits on garments generate a visible grayish staining and attract even more soil due to the stickiness of the mineral incrustation, leading to an unpleasant appearance and being detrimental to the "soft feel" of the garment. Controlled release of acid has a softening effect on fabrics and is beneficial in longer lasting fragrances, since it provides improved adherence of fragrances to the garment.

Finally, lactic acid has a sanitizing and disinfecting effect due to its antibacterial activity.

The glycolic and/or lactic acid oligomer as described herein encompasses both straight-chain and cyclic glycolic and/or lactic acid oligomers. Preferably, the glycolic and/or lactic acid oligomer is glycolide and/or lactide, which are cyclic glycolic and/or lactic acid dimmers.

In a particular embodiment of the present invention the glycolic and/or lactic acid oligomer is for at least 50 wt. % made up of glycolide and/or lactide, more in particular, the glycolic and/or lactic acid oligomer is for at least 70 wt. % made up of glycolide and/or lactide, still more in particular for at least 80%, even more in particular for at least 90%.

In a single-phase detergent composition, the detergent composition may comprise 5-70 wt. % of the glycolic and/or lactic acid oligomer based on total weight of the detergent composition, preferably 10-60 wt. %, more preferably 20-50 wt. %. It is an option to formulate the glycolic and/or lactic acid oligomer and the alkaline detergent components in separate phases of the detergent composition, which option is preferred when applying the glycolic and/or lactic acid oligomer in the higher concentration ranges. In a multi-phase detergent composition, the detergent composition may comprise 10-95 wt. % of the glycolic and/or lactic acid oligomer based on weight of the phase containing the glycolic and/or lactic acid oligomer, preferably 25-90 wt. %, more preferably 40-80 wt. %.

In the cleaning cycle, the detergent composition may be included in the aqueous diluent in a concentration of 200 to 5000 parts by weight of the detergent composition per each one million parts of the aqueous diluent.

The cleaning cycle can be performed at any desired temperature effectuating hydrolysis of the oligomer and release of the acid, e.g. from about 20° C. to about 90° C. An appropriate temperature is 60° C.

At 60° C., release of the acid occurs in about 30 minutes, whereas the other components of the detergent composition typically have a dissolution time of less than 5 minutes.

In addition to the ingredients described herein above, the detergent composition may comprise conventional ingredients, preferably selected from caustic agents, builders (i.e. detergency builders including the class of chelating agents/sequestering agents), bleaching systems, anti-scalants, corrosion inhibitors, surfactants, antifoams and/or enzymes.

Suitable caustic agents include alkali metal hydroxides, e.g. sodium or potassium hydroxides, and alkali metal silicates, e.g. sodium metasilicate. Especially effective is sodium silicate having a mole ratio of $SiO_2$:$Na_2O$ of from about 1.0 to about 3.3, preferably from about 1.8 to about 2.2, normally referred to as sodium disilicate.

The pH of the detergent composition typically is in the neutral to alkaline region, i.e. from 6-11, preferably from 7-10.

Suitable builder materials (phosphates and non-phosphate builder materials) are well known in the art and many types of organic and inorganic compounds have been described in the literature. They are normally used in all sorts of cleaning compositions to provide alkalinity and buffering capacity, prevent flocculation, maintain ionic strength, extract metals from soils and/or remove alkaline earth metal ions from washing solutions.

The builder material usable herein can be any one or mixtures of the various known phosphate and non-phosphate builder materials. Examples of suitable non-phosphate builder materials are the alkali metal citrates, carbonates and bicarbonates; and the salts of nitrilotriacetic acid (NTA); methylglycine diacetic acid (MGDA); glutaric diacetic acid (GLDA), EDTA, polycarboxylates such as polymaleates, polyacetates, polyhydroxyacrylates, polyacrylate/polymaleate and polyacrylate/polymethacrylate copolymers, as well as zeolites; layered silicas and mixtures thereof. They may be present (in % by wt.), in the range of from 1 to 70, and preferably from 5 to 60, more preferably from 10 to 60.

The use of the glycolic and/or lactic acid oligomer as described herein advantageously obviates the need to include builder materials with sequestrant function, such as non-biodegradable builders like NTA and EDTA, since the slow release of acid will provide reaction with hard water metals such as calcium and/or magnesium.

Particularly preferred builders are phosphates, MGDA, GLDA, citrates, carbonates, bicarbonates, polyacrylate/polymaleate, maleic anhydride/(meth)acrylic acid copolymers, e.g. Sokalan CP5 available from BASF.

Surfactants, especially nonionics, may be present to enhance cleaning and/or to act as defoamer. Suitable surfactants further may include anionic, cationic or amphoteric surfactants, or mixtures thereof. Typically used nonionics are obtained by the condensation of alkylene oxide groups with an organic hydrophobic material which may be aliphatic or alkyl aromatic in nature, e.g. selected from the group consisting of a C2-C18 alcohol alkoxylate having EO, PO, BO and PEO moieties or a polyalkylene oxide block copolymer.

The surfactant may be present in a concentration of about 0.1% to about 10% by weight, preferably from 0.2% to about 5% by weight, most preferably from about 0.5% to about 2% by weight.

Suitable bleaches for use in the detergent may be halogen-based bleaches or oxygen-based bleaches. More than one kind of bleach may be used.

As halogen bleach, alkali metal hypochlorite may be used. Other suitable halogen bleaches are alkali metal salts of di- and tri-chloro and di- and tri-bromo cyanuric acids.

Suitable oxygen-based bleaches are inorganic peroxides or organic peracids, derivatives thereof (including their salts) and mixtures thereof. Especially preferred inorganic peroxides are percarbonates, perborates and persulphates with their sodium and potassium salts being most preferred. Sodium percarbonate and sodium perborate are most preferred, especially sodium percarbonate. Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidolperoxycarboxylic acid and, optionally, the salts thereof. Especially preferred is phthalimidoperhexanoic acid (PAP). Desirably if the bleaching compound is used, it is present in an amount of from 1 to 25 wt %, especially 5 to 20 wt %, based on the total weight of the composition.

If the detergent compositions comprise a bleaching compound, they also preferably comprise one or more bleach activators and or one or more bleach catalysts. Any suitable bleach activator may be included for example TAED. Any suitable bleach catalyst may be included. Conventional amounts of both the bleach catalyst and bleach activator may be used e.g. independently for both the bleach activator and bleach catalyst, amounts of from 0.01 to 10 wt %, more preferred of from 0.1 to 8 wt % and most preferred of from 0.5 to 5 wt % based on the weight of the total composition.

Amylolytic, cellulolytic, proteolytic and/or lipolytic enzymes would normally be used as an enzymatic component. The enzymes usable herein can be those derived from bacteria or fungi.

The detergent composition may further comprise components with a rinse aid function, such as components which aid the wetting of the substrates in the rinse, such as nonionic surfactants and/or hydrotropes, and sometimes other additives improving the efficacy of the rinsing process, such as polymers and/or silicones.

Minor amounts of various other components may be present in the detergent composition. These include hydrotropes such as xylene sulfonates, flow control agents, disintegrants, enzyme stabilizing agents, anti-redeposition agents, corrosion inhibitors, fragrances and other functional additives.

The detergent composition may be in solid form, for instance may be a (granular) powder, a tablet or a solid block.

When in powder form, a flow control agent may be included to provide good flow properties and to prevent lump formation of the powder.

When in tablet form, a disintegrant may be included to promote disintegration of the tablet. Various classes of disintegrant are known, including the class in which disintegration is caused by swelling of the disintegrant. Various swelling disintegrants have been proposed in the literature, with the preference being directed predominantly towards starches, celluloses and water soluble organic polymers. Inorganic swelling disintegrants such as bentonite clay have also been mentioned.

The detergent composition may be encased in a water-soluble pouch or sachet. The detergent composition further may be in a unit dose form.

The detergent composition may be formed by, for instance, compression of powder ingredients, mixing of ingredients in a pourable melt, extrusion, or any combination thereof.

In a preferred embodiment, certain components of the solid detergent composition, in particular of a unit dose detergent composition, are formulated separately from each other. For instance, certain components of the detergent composition may be present in at least two separate compartments of a water soluble pouch, or may be present in at least two separate layers or compartments of a tablet or solid block. Such a detergent composition, wherein certain components are formulated separately from each other, is commonly known as a multi-phase detergent composition. In such a multi-phase detergent composition, it is especially preferred that the glycolic and/or lactic acid oligomer is in a separate phase from at least the major part of the alkaline components.

Thus, in a second aspect, the present invention discloses a multi-phase detergent composition wherein, on the one hand, at least the glycolic and/or lactic acid oligomer and, on the other hand, at least a major part of the alkaline component(s) of the detergent composition are present in separate phases of the detergent composition.

With "at least a major part" of the alkaline component(s) of the detergent composition is meant at least 60%, preferably at least 70%, more preferably at least 80%, most preferably at least 90% of the alkaline component(s) of the detergent composition.

The alkaline component(s) of the detergent composition may encompass components like caustic agents and alkaline builders.

Such a detergent composition thus comprises at least two phases. One phase comprises the glycolic and/or lactic acid oligomer and a further phase comprises at least a major part of the alkaline component(s).

It is envisaged that more than one functional component may be included in more than one further phase. In addition, potentially chemically sensitive and/or mutually incompatible components may be separated from each other by formulation in separate phases, in order to avoid any loss in performance caused by components reacting together and potentially becoming inactive or exhausted.

A barrier layer comprising a barrier layer composition may be located between the various phases of the multi-phase solid detergent composition. The barrier layer composition may comprises at least one binder selected from the group consisting of organic polymers, for example granular and liquid polyethylene and/or polypropylene glycols, especially those of molecular weight 4000, 6000 and 9000, polyvinyl pyrolindone (PVP), especially PVP of molecular weight 90000, polyacrylates, sugars and sugar derivatives, starch and starch derivatives, for example hydroxy propyl methyl cellulose (HPMC) and carboxy methyl cellulose (CMC); and inorganic polymers, such as hexametaphosphate.

The advantage of the presence of a barrier layer is to prevent or reduce migration of components from one phase to another phase.

The concentration of the glycolic and/or lactic acid oligomer in the respective phase of the multi-phase detergent composition is 10-95 wt. % based on the total weight of the respective phase, preferably 25-90 wt. %, more preferably 50-85 wt. %.

Preferably, the multi-phase detergent composition is in a solid form, for instance is a (granular) powder, a tablet or a solid block.

The multi-phase detergent composition may be encased in a water-soluble pouch or sachet. The multi-phase detergent composition further may be in a unit dose form.

With this concept of slow release of acid, the use of all-in one detergent compositions is feasible, since the use of, for instance, a separate rinse aid or fabric softener is obviated. Thus, an effective washing process is obtained for automatic washing machines, which provides increased simplicity, like no packaging, processing, transport and storage of a separate rinse aid or fabric softener, but also by eliminating the need for a pump to dose a separate rinse aid or fabric softener into the rinse solution.

EXAMPLE 1

Preparation of Solid Blocks Containing Lactide

The ingredients as mentioned in Table 1 for the respective separate phases 1 and 2 were mixed in a glass beaker and melted by use of a micro-wave. Fragrances and dye were added as final step after a homogenous liquid mixture was obtained. Phase 2 of the prepared formulations A-I was a transparent and homogenous liquid having a melting point of above 60° C., whereas phase 1 was a pourable melt containing solid particles.

Of each phase 12.5 g were taken and poured into a mold having a dimension of 3.5×3.5×0.8 cm. Before solidification the molds containing the two respective phases were put on top of each other and further cooled down, thus forming a two layered rigid block of ±25 g having a dimension of 3.5×3.5×1.6 cm.

The prepared rigid blocks consist of a two-phase system, phase 1 containing the alkaline detergent component and phase 2 containing the slow release acid generating component.

All prepared formulations have a typical melting point of above 60° C.; lactide itself has a melting point of about 110° C.

TABLE 1

Compositions of lactide based machine dishwashing formulations

| % ingredients | Phase 1 | Phase 2 | Phase 1 | Phase 2 | Phase 1 | Phase 2 |
|---|---|---|---|---|---|---|
| | A | | B | | C | |
| Sodium carbonate | 32 | | 25 | | 30 | |
| Sodium sulphate | 32.9 | | 34.9 | | | |
| Lactide | | 55 | | 55 | | 55 |
| PEG 8000 | 20 | 39.5 | 20 | 39.5 | 19.9 | 39.5 |
| Zinc lactate | | 0.5 | | 0.5 | | 0.5 |
| Fragrance | 0.1 | | 0.1 | | 0.1 | |
| Genapol OA80 (Fatty alcohol EO8) | 15 | 5 | 20 | 5 | 15 | 5 |
| Na metasilicate 5H20 | | | | | 35 | |

TABLE 1-continued

Compositions of lactide based machine dishwashing formulations

| % ingredients | Phase 1 | Phase 2 | Phase 1 | Phase 2 | Phase 1 | Phase 2 |
|---|---|---|---|---|---|---|
| | D | | E | | F | |
| Sodium carbonate | | | | | 12.5 | |
| Sodium sulphate | | | 29.9 | | 32.4 | |
| Lactide | | 55 | | 55 | | 55 |
| PEG 8000 | 16.7 | 39.5 | 20 | 40 | 20 | 40 |
| Zinc lactate | | 0.5 | | | | |
| Zeolite (Doucil A28) | 33.3 | | | | | |
| Sodium bisulphate | 20.7 | | 35 | | 17.5 | |
| Fragrance | 0.08 | | 0.1 | | 0.1 | |
| Water | 16.7 | | | | | |
| Genapol OA80 (Fatty alcohol EO8) | 12.5 | 5 | 15 | 5 | 17.5 | 5 |
| | G | | H | | I | |
| Sodium carbonate | 4.9 | | 14.9 | | | |
| Sodium sulphate | | | | | 19.9 | |
| Lactide | | 55 | | 55 | | 55 |
| PEG 8000 | 20 | 39.5 | 20 | 40 | 20 | 40 |
| Zinc lactate | | 0.5 | | | | |
| Sodium tripolyphosphate | 20 | | 40 | | 45 | |
| Sodium percarbonate | 40 | | 10 | | | |
| Fragrance | 0.1 | | 0.1 | | 0.1 | |
| Genapol OA80 (Fatty alcohol EO8) | 15 | 5 | 15 | 5 | 15 | 5 |

EXAMPLE 2 pH-Development in Demineralised Water at 60° C.

For measuring the release of acid, 500 mL glass beakers (high model) were taken and the blocks were placed on a special holding device, which made it possible to stir the solution without affecting the blocks. The solutions were stirred on a multi-stirring plate at a constant stirring speed of ±500 rpm and kept at 60° C. The pH was followed in time, until the block was completely dissolved or a stable pH was reached.

FIGS. 1A,B,C show the development of the pH over time for each composition A to I. It can be seen that the pH gradually decreases, indicating gradual release of acid over time. The neutral to alkaline detergent phase had a dissolution time of less than 5 minutes, whereas the acid release phase showed a dissolution time of about 30 minutes.

As comparison, three commercial dish washing tablets were tested in the same way. These tablets did not show a decrease in pH (see Table 2).

TABLE 2 pH development after dissolution of three commercial tablets

| | Commercial tablet/pouch | | |
|---|---|---|---|
| Time minutes | Calgonit Powerball Quantum (2007) | Sun All In One (2007) | Dreft Ultra Caps All In One (2007) |
| 10 | 9.92 | 10.34 | 10.23 |
| 25 | 9.91 | 10.37 | 10.22 |
| 65 | 9.91 | 10.35 | 10.22 |
| 110 | 9.90 | 10.33 | 10.22 |

The invention claimed is:

1. A method for cleaning a substrate comprising contacting the substrate in a cleaning cycle with an aqueous cleaning solution comprising an aqueous diluent and a detergent composition, the detergent composition comprising a glycolic and/or lactic acid oligomer with an average degree of polymerization between 1.8 and 6.

2. The method according to claim 1, further comprising contacting the substrate in a rinse cycle with an aqueous rinse, the aqueous rinse being substantially free of an intentionally added rinse agent or fabric softener.

3. The method according to claim 1, wherein the glycolic and/or lactic acid oligomer is glycolide and/or lactide.

4. The method according to claim 1, wherein the detergent composition is a single-phase composition comprising 5-70 wt. % of the glycolic and/or lactic acid oligomer based on the total weight of the detergent composition.

5. The method according to claim 1, wherein the detergent composition is a multi-phase composition comprising 10-95 wt. % of the glycolic and/or lactic acid oligomer based on the weight of the phase containing the glycolic and/or lactic acid oligomer.

6. The method according to claim 1, wherein the aqueous cleaning solution comprises about 200 to 5000 parts by weight of the detergent composition per each one million parts of the aqueous diluent.

7. The method according to claim 1, wherein the method is for automatic dish washing or automatic laundry washing.

8. The method according to claim 1, wherein the glycolic and/or lactic acid oligomer provides a controlled release of glycolic and/or lactic acid in the cleaning solution generating an acidic pH gradient in the cleaning solution during the cleaning cycle.

* * * * *